US010244323B2

(12) United States Patent
Zhu et al.

(10) Patent No.: US 10,244,323 B2
(45) Date of Patent: Mar. 26, 2019

(54) VIBRATION SOUND-PRODUCING APPARATUS

(71) Applicant: GOERTEK INC., WeiFang, Shandong (CN)

(72) Inventors: Yueguang Zhu, Shandong (CN); Hongchao Sun, Shandong (CN); Chao Xu, Shandong (CN)

(73) Assignee: GOERTEK INC., WeiFang, Shandong (CN)

( * ) Notice: Subject to any disclaimer, the term of this patent is extended or adjusted under 35 U.S.C. 154(b) by 0 days.

(21) Appl. No.: 15/575,276

(22) PCT Filed: Nov. 16, 2015

(86) PCT No.: PCT/CN2015/094687
§ 371 (c)(1),
(2) Date: Nov. 17, 2017

(87) PCT Pub. No.: WO2016/192317
PCT Pub. Date: Dec. 8, 2016

(65) Prior Publication Data

US 2018/0146294 A1 May 24, 2018

(30) Foreign Application Priority Data

Jun. 5, 2015 (CN) ..... 2015 1 0306233

(51) Int. Cl.
*H04R 3/00* (2006.01)
*H04R 9/02* (2006.01)
(Continued)

(52) U.S. Cl.
CPC ..... *H04R 9/025* (2013.01); *H04R 1/38* (2013.01); *H04R 3/00* (2013.01); *H04R 9/047* (2013.01);
(Continued)

(58) Field of Classification Search
USPC ..... 381/96, 115, 117, 162, 164, 185, 347, 381/348, 403, 422, 423
See application file for complete search history.

(56) References Cited

U.S. PATENT DOCUMENTS 4,860,370 A * 8/1989 Grosbard ..... H04R 3/002 381/403
2013/0051603 A1* 2/2013 Takewa ..... H04R 9/04 381/398
2015/0117699 A1* 4/2015 Cai ..... H01F 7/0289 381/412

FOREIGN PATENT DOCUMENTS

CN 102256195 A 11/2011
CN 203086664 U 7/2013
(Continued)

OTHER PUBLICATIONS

International Search Report in International Application No. PCT/CN2015/094687, filed Nov. 16, 2015.

*Primary Examiner* — Yosef K Laekemariam
(74) *Attorney, Agent, or Firm* — Saliwanchik, Lloyd & Eisenschenk

(57) ABSTRACT

Disclosed is a vibration sound-producing apparatus. A sound output aperture is provided on a sidewall perpendicular to a thickness direction. A diaphragm is parallel to the plane on which the sound output aperture is located. A flat sound coil is perpendicular to the diaphragm. Two magnets parallel to the sound coil are arranged at either side of the sound coil. The vibrating direction of the sound coil avoids the thickness direction. The vibrating direction of an integral structure of the magnets and a magnetic conductor part also avoids the thickness direction. This facilitates a thickness-reduced design for a product, increases the space for vibration, and enhances product performance, meanwhile, the design of the two magnets effectively increases the strength
(Continued)

of the magnetic field within the product, this further improving product performance. The vibration sound-producing apparatus of the present invention has the advantages of a great thickness-reduced design and great performance.

12 Claims, 4 Drawing Sheets

(51) Int. Cl.

| | |
|---|---|
| ***H04R 9/06*** | (2006.01) |
| ***H04R 1/38*** | (2006.01) |
| ***H04R 9/04*** | (2006.01) |
| *H04R 7/16* | (2006.01) |

(52) U.S. Cl.
CPC ..... *H04R 9/06* (2013.01); *H04R 3/002* (2013.01); *H04R 7/16* (2013.01)

(56) References Cited

FOREIGN PATENT DOCUMENTS

| | | | |
|---|---|---|---|
| CN | 104883649 | A | 9/2015 |
| CN | 104883650 | A | 9/2015 |
| CN | 204697286 | U | 10/2015 |
| CN | 204761697 | U | 11/2015 |

* cited by examiner

VIBRATION SOUND-PRODUCING APPARATUS

CROSS-REFERENCE TO RELATED APPLICATIONS

This application is the U.S. national stage application of International Patent Application No. PCT/CN2015/094687, filed Nov. 16, 2015, which claims priority to Chinese Application No. 201510306233.9, filed Jun. 5, 2015, the disclosures of each of which are incorporated herein by reference in their entirety.

TECHNICAL FIELD

The present invention relates to the technical field of electroacoustics, and more particularly, to a vibration sound-producing apparatus.

BACKGROUND ART

A vibration speaker is a multi-functional acoustic device, which may not only achieve the vibration sound-producing functionality as an ordinary speaker, but also achieve the functionality of a vibrating motor. The vibration speaker may save the internal space of a portable electronic terminal, simplify the assembly process of the portable electronic terminal, and reduce the cost of the portable electronic terminal. Therefore, the vibration speaker has been increasingly and widely used in the field of portable electronic terminal.

The existing vibration sound-producing apparatus with a conventional structure comprises a vibration system and magnetic circuit system. The vibration system comprises a vibrating diaphragm, and a cylindrical voice coil which is integrated with the vibrating diaphragm. The magnetic circuit system comprises a magnet, and a magnetic gap in which the cylindrical voice coil is provided. When the vibration speaker is in operation, the cylindrical voice coil drives the vibrating diaphragm to vibrate in the vertical direction to produce sound under lorentz force, while the magnetic circuit system is subjected to reaction force and resonates in the vertical direction. The vibration speaker with such a structure is limited in the volume of the cylindrical voice coil and the space for vibration of the cylindrical voice coil, and a mass block combined with the magnetic circuit system is further required to be provided in the vertical direction, which thickens the thickness in the vertical direction and cannot meet the requirement on thin-type of the product. With the improvements on thin-type and miniaturization design of the portable electronic terminal, the existing vibration sound-producing apparatus cannot meet the development trend of thin-type and miniaturization.

Therefore, it is necessary to provide an improvement to overcome the drawbacks of the vibration sound-producing apparatus in the prior art.

SUMMARY

The technical problem sought to be solved by the present invention is to provide a vibration sound-producing apparatus having improved thin-type design and good performance.

In order to achieve the above objective, the vibration sound-producing apparatus of the present invention employs the following technical solution:

a vibration sound-producing apparatus, comprising a housing, and a vibration system and a magnetic circuit system accommodated in the housing, wherein a lateral surface of the housing is provided with a sound hole for emitting sound; the vibration system comprises a vibrating diaphragm, a voice coil and a transmission structure, the vibrating diaphragm is provided at a position corresponding to the sound hole, and a plane in which the vibrating diaphragm is located is parallel to the lateral surface in which the sound hole is located; the voice coil has a flat structure, and a plane in which the voice coil is located is perpendicular to the plane in which the vibrating diaphragm is located; the vibrating diaphragm and the voice coil are connected with each other through the transmission structure; the magnetic circuit system comprises a first magnet portion and a second magnet portion, and the first magnet portion and the second magnet portion are provided at two sides of the voice coil having the flat structure respectively; the first magnet portion and the second magnet portion are arranged in parallel with the voice coil; the vibration sound-producing apparatus further comprises a magnetic conductive part, a joint part and an elastic means; the magnetic conductive part is suspended inside the housing through the elastic means; the magnetic conductive part comprises a first magnetic conductive part and a second magnetic conductive part, the first magnet portion is fixed to the first magnetic conductive part, and the second magnet portion is fixed to the second magnetic conductive part; and the first magnetic conductive part and the second magnetic conductive part are connected with each other through the joint part.

As a preferred technical solution, the first magnet portion and the second magnet portion are symmetrically arranged with respect to the voice coil, a polarity of the first magnet portion at a side of the first magnet portion adjacent to the voice coil is opposite to a polarity of the second magnet portion at a side of the second magnet portion adjacent to the voice coil.

As a preferred technical solution, the joint part consists of two parts, and the two parts of the joint part are provided at two ends of the magnetic conductive part correspondingly.

As a preferred technical solution, the elastic means is an elastic piece, and the magnetic conductive part is vibratable in an elastic direction of the elastic piece.

As a preferred technical solution, the magnetic conductive part is provided with a limiting block at a position where the joint part is fixed to the magnetic conductive part, and the joint part is provided with a limiting recess at a position corresponding to the limiting block.

As a preferred technical solution, each of the first magnet portion and the second matmet portion comprises two magnets, and the two magnets of the first magnet portion and the two magnets of the second magnet portion are fixed to the first magnetic conductive part and the second magnetic conductive part, respectively.

As a further preferred technical solution, the magnetic conductive part is provided with a barrier wall, and the barrier wall separates the two magnets.

As a further preferred technical solution, the voice coil has a racetrack shape, the two magnets of the first magnet portion correspond to two straight sides of the voice coil having the racetrack shape, respectively, and the two magnets of the second magnet portion also correspond to the two straight sides of the voice coil having the racetrack shape, respectively.

As a preferred technical solution, the transmission structure comprises a transmission arm, and the transmission arm is provided with a recess at a position where the voice coil is fixed to the transmission arm, wherein a shape of the recess is adapted to a shape of the voice coil.

As a further preferred technical solution, the transmission structure comprises two transmission arms, and the two transmission arms are provided at two ends of the voice coil.

In the vibration sound-producing apparatus of the present invention, the sound hole is provided in the lateral surface of the housing of the sound-producing apparatus, which avoids the requirement on thickness of the external portable electronic terminal in the vertical direction due to a front sound hole, and avoids blocking of the sound hole due to insufficient thickness in the vertical direction of the electronic terminal, thereby ensuring the sound effect of the vibration sound-producing apparatus; the vibrating diaphragm of the vibration system corresponds to the sound hole, that is, the plane of the vibrating diaphragm is parallel to the lateral surface in which the sound hole is located. The voice coil has a flat structure, and the plane of the voice coil is perpendicular to the plane of the vibrating diaphragm, which effectively decreases the occupancy of the voice coil in the thickness of the vibration sound-producing apparatus, and changes the vibration direction of the voice coil during operation of the vibration sound-producing apparatus, so that the voice coil vibrates in the horizontal direction and drives the vibrating diaphragm to vibrate and generate sound through the transmission structure; the plane in which the magnet is located is parallel to the plane of the voice coil, and the magnet is fixed to the magnetic conductive part and is suspended inside the housing, and the magnet is subjected to the reaction force applied by the voice coil when the voice coil is energized, so that the magnet and the magnetic conductive part resonate integrally at a certain frequency, and vibrate back and forth in the plane in which the magnet is located, and thus the vibration sound-producing apparatus achieves vibration function. In the vibration sound-producing apparatus according to the present invention, as the voice coil has a flat structure, the size limit of the external portable electronic terminal on the vibration sound-producing apparatus in the vibrating direction of the voice coil is small, which enables the voice coil to obtain a larger space for vibration and increase the amplitude, thereby improving the performance of vibration sound-producing apparatus. At the same time, in the vibration sound-producing apparatus of the present invention, the magnet comprises a first magnet portion and a second magnet portion, and the first magnet portion and the second magnet portion are provided at two sides of the voice coil respectively and in parallel with the voice coil, thereby effectively improving the magnetic field strength inside the vibration sound-producing apparatus, improving the acting force applied to the conductive voice coil, and effectively improving the product performance. Therefore, the vibration sound-producing apparatus of the present invention has the advantages of improved thin-type design and good performance.

DETAILED DESCRIPTION OF EMBODIMENTS

Hereinafter, the contents of the present invention will be described in detail with reference to the accompanying drawings.

Figure 1:
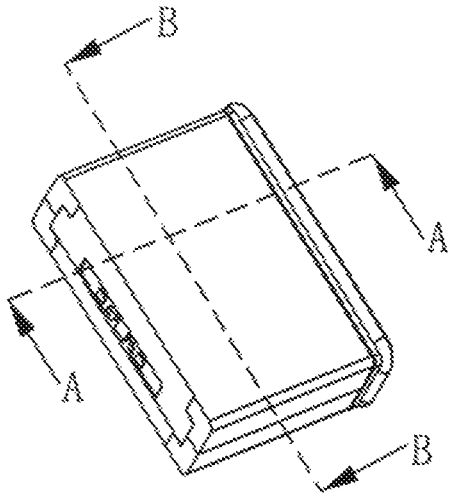
FIG. 1 is a perspective view of a specific embodiment of the vibration sound-producing apparatus of the present invention.
Figure 2:
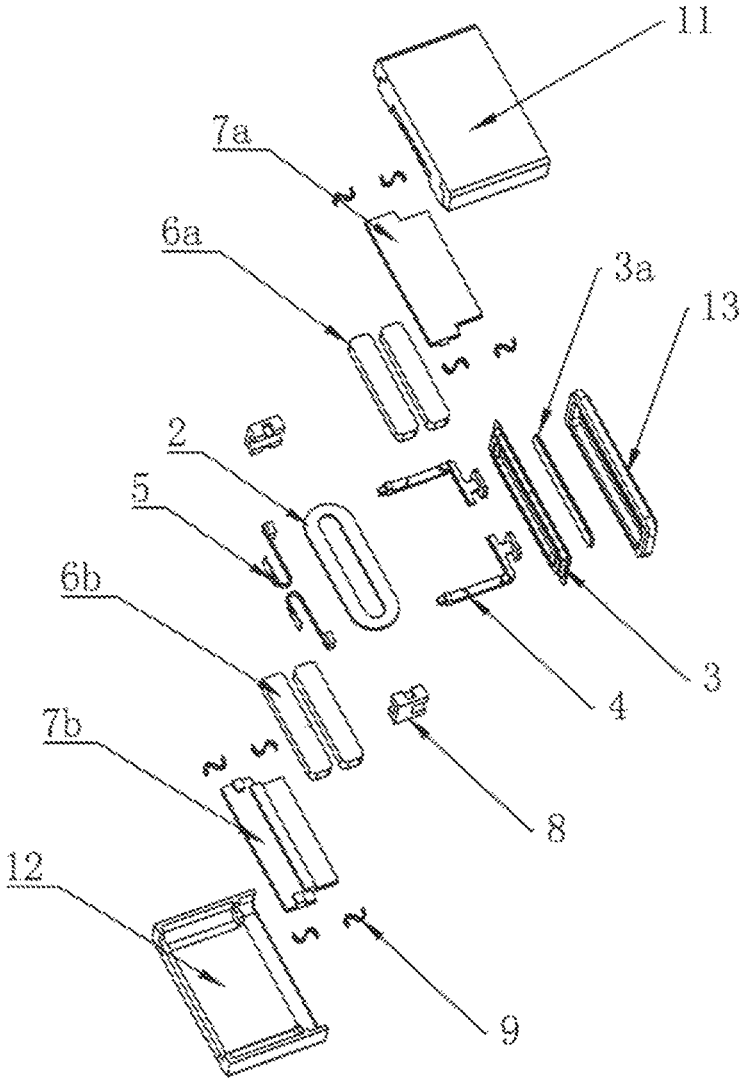
FIG. 2 is an exploded view of the vibration sound-producing apparatus shown in FIG. 1.
Figure 3:
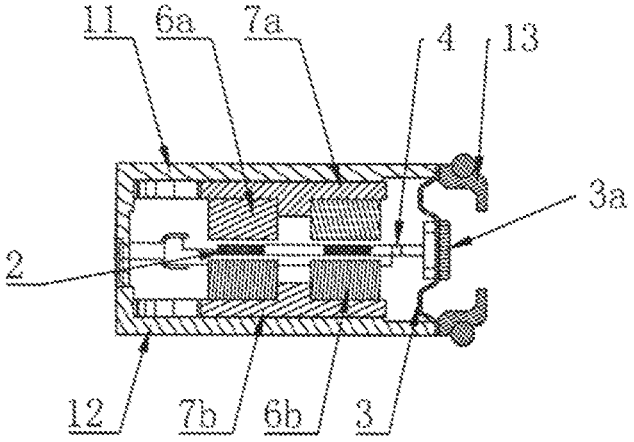
FIG. 3 is a sectional view taken along line A-A of the vibration sound-producing apparatus shown in FIG. 1.
Figure 4:
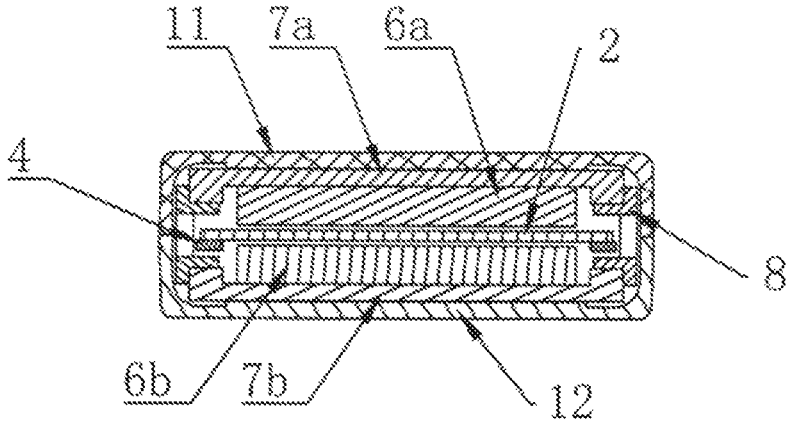
FIG. 4 is a sectional view taken along line B-B of the vibration sound-producing apparatus shown in FIG. 1.

As shown in FIG. 2, the vibration sound-producing apparatus of the present invention comprises a housing, a vibration system and a magnetic circuit system. The housing comprises a first housing 11, a second housing 12, and a side cover 13 fixed to the side walls of the first housing 11 and the second housing 12. The vibration system and the magnetic circuit system are provided in the cavity defined by the first housing 11, the second housing 12, and the side cover 13. The side cover 13 is provided with a sound hole for emitting sound. As shown in FIGS. 2 and 3, the vibration system comprises a vibrating diaphragm 3, a voice coil 2, and a transmission structure 4. The vibrating diaphragm 3 is provided at a position facing the side cover 13 in which the sound hole is provided, that is, the vibrating diaphragm 3 is provided at a position adjacent to the side cover 13, and the plane in which the vibrating diaphragm 3 is located is parallel to the plane in which the side cover 13 is located. The voice coil 2 has a flat structure, and the plane in which the voice coil 2 is located is perpendicular to the plane in which the vibrating diaphragm 3 is located. In the vibration sound-producing apparatus of the present embodiment, the transmission structure connecting the voice coil 2 and the vibrating diaphragm 3 comprises a transmission arm 4, and the transmission arm 4 transfers the vibration of the voice coil 2 to the vibrating diaphragm 3. As shown in FIGS. 2, 3 and 4, the magnetic circuit system comprises a magnet, the magnet is provided at a position facing the voice coil 2, and the plane in which the magnet is located is parallel to the plane in which the voice coil 2 is located. The vibration sound-producing apparatus of the present invention further comprises a magnetic conductive part. The magnet and the magnetic conductive part are fixed together. The magnetic conductive part is suspended inside the housing via an elastic means 9. The integral structure of the magnetic conductive part and the magnet vibrate back and forth in the housing in the force direction of the magnet. In the vibration sound-producing apparatus of the present invention, when the external drive current flows into the voice coil 2, as the voice coil 2 is provided in the magnetic field of the magnet, the current in the voice coil 2 provided in the magnetic field changes, so that the voice coil 2 vibrates in the plane in which the voice coil is located due to Lorentz force, and the voice coil 2 vibrates to drive the transmission arm 4 to vibrate, thereby transmitting the vibration to the vibrating diaphragm 3 and enabling the vibrating diaphragm 3 to vibrate and generate sound. When the voice coil 2 is subjected to a magnetic field force, the magnet is also subjected to a reaction force, and the magnet vibrates. When the frequency of the force applied to the magnet is the same as the resonant frequency of the integral structure of the magnet and the magnetic conductive part, the integral structure of the magnet and the magnetic conductive part vibrates significantly, and thus the vibration sound-producing apparatus is in a vibrating state. In the vibration sound-producing apparatus according to the present invention, as the voice coil has a flat structure, in the vibrating direction of the voice coil, the size limit of the external portable electronic terminal on the vibration sound-producing apparatus is small, which enables the voice coil to obtain a larger space for vibration and increase the amplitude, thereby improving the performance of the vibration sound-producing apparatus. Meanwhile, when the vibration sound-producing apparatus of the present invention achieves vibration function, the vibration direction of the integral structure of the magnet and the magnetic conductive part is also in the horizontal direction, which avoids occupancy in the thickness and further decrease the thickness of the product, and the size limit in the vibration direction is small, thereby further improving the performance of vibration function. Therefore, the vibration sound-producing apparatus of the present invention has the advantages of improved thin-type design and great performance.

Figure 7:
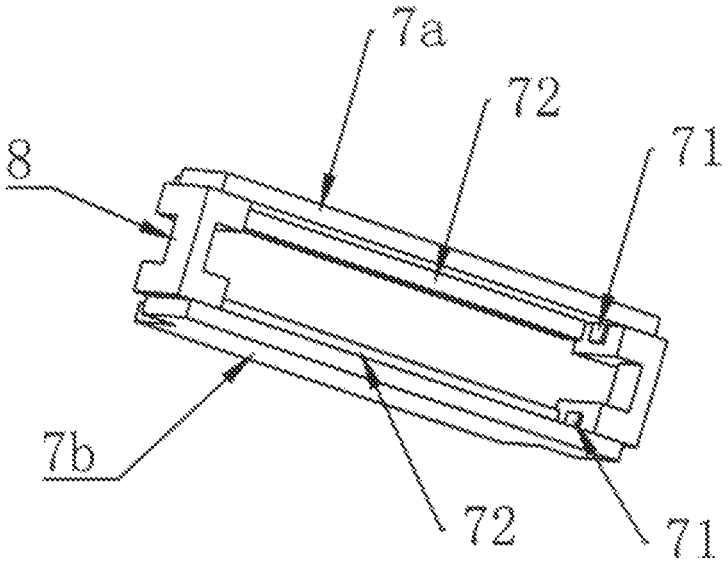
FIG. 7 is a schematic view of the assembly of the magnetic conductive part and the joint part of the vibration sound-producing apparatus shown in FIG. 1.

As shown in FIGS. 2 and 3, in the vibration sound-producing apparatus according to the present invention, the magnet comprises a first magnet portion 6*a* and a second magnet portion 6*b*, the first magnet portion 6*a* and the second magnet portion 6*b* are provided at two sides of the voice coil 2 respectively, and the first magnet portion 6*a* and the second magnet portion 6*b* are arranged in parallel with the voice coil 2. As shown in FIGS. 2 and 3, the magnetic conductive part comprises a first magnetic conductive part 7*a* and a second magnetic conductive part 7*b*, the first magnet portion 6*a* is fixed to the first magnetic conductive part 7*a*, and the second magnet portion 6*b* is fixedly combined with the second magnetic conductive part 7*b*. As shown in FIGS. 2, 4 and 7, the first magnetic conductive part 7*a* and the second magnetic conductive part 7*b* are integrally connected through a joint part 8. When the magnetic conductive part vibrates, the first magnetic conductive part 7*a* and the second magnetic conductive part 7*b* vibrate integrally, which facilitates the consistency of vibration of the vibration sound-producing apparatus and improvement of the vibration performance. The vibration sound-producing apparatus of the present invention is provided with a first magnet portion and a second magnet portion to effectively improve the internal magnetic field strength and the product performance.

As shown in FIG. 2, in the vibration sound-producing apparatus of the present embodiment, the first magnet portion 6*a* and the second magnet portion 6*b* are arranged symmetrically with respect to the voice coil 2. In order to improve the magnetic field strength in the space in which the voice coil is located in practical application, the polarity of the first magnet portion 6*a* at a side of the first magnet portion 6*a* adjacent to the voice coil 2 is opposite to the polarity of the second magnet portion 6*b* at a side of the second magnet portion 6*b* adjacent to the voice coil 2.

In order to effectively combine the first magnetic conductive part 7*a* and the second magnetic conductive part 7*b* so as to improve the bonding strength, ensure the consistency of vibration and improve the vibration performance, as shown in FIGS. 2 and 4, in the vibration sound-producing apparatus of the present embodiment, the joint part 8 consists of two parts, and the two parts of the joint part 8 are provided at two ends of the magnetic conductive part respectively.

Figure 5:
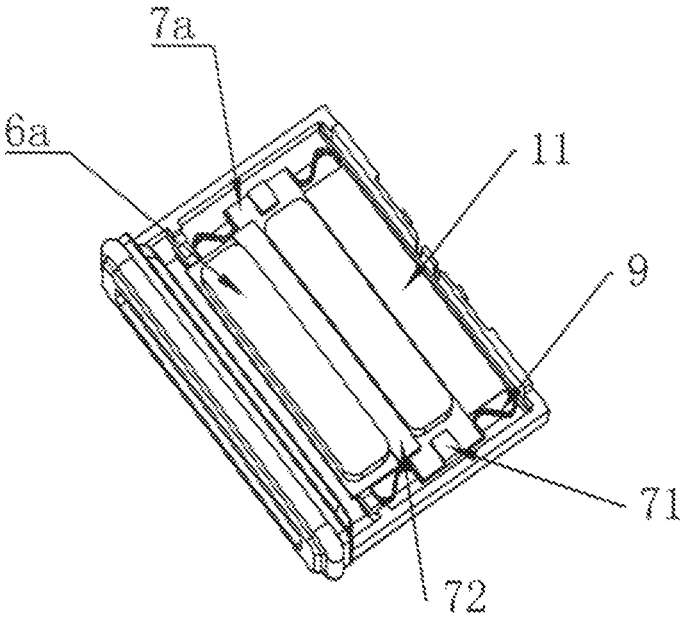
FIG. 5 is a schematic view of the assembly of the magnetic circuit at a side of the vibration sound-producing apparatus shown in FIG. 1.

As shown in FIGS. 2 and 5, in the vibration sound-producing apparatus of the present embodiment, the magnetic conductive part and the housing are connected with each other through elastic pieces 9, and the magnetic conductive part is suspended inside the housing through the elastic pieces 9. The first magnetic conductive part 7*a* is fixed to the first housing 11 through four elastic pieces 9, and the second magnetic conductive part 7*b* is fixed to the second housing 12 through four elastic pieces 9. The four elastic pieces are provided at four corners of the first magnetic conductive part 7*a* or the second magnetic conductive part 7*b*. This configuration may ensure the bonding strength between the magnetic conductive part and the housing. At the same time, when the magnetic conductive part vibrates, it vibrates in the vibration direction of the elastic pieces, and the elastic pieces provide good resilience force, so that the vibration performance is improved.

As shown in FIGS. 5 and 7, the magnetic conductive part is provided with a limiting block 71, and the joint part 8 is provided with a limiting recess at the position facing the limiting block 71. When the magnetic conductive part is fixed to the joint part 8, the limiting block 71 is fitted in the limiting recess of the joint part 8, thereby improving the bonding strength between the magnetic conductive part and the joint part and improving the product performance.

In order to further improve the magnetic field strength inside the vibration sound-producing apparatus, as shown in FIGS. 2 and 3, each of the first magnet portion 6*a* and the second magnet portion 6*b* comprises two magnets. The first magnet portion 6*a* comprising two magnets and the second magnet portion 6*b* comprising two magnets are fixedly combined with the first magnetic conductive part 7*a* and the second magnetic conductive part 7*b* respectively. In order to avoid offset of the magnets due to mutual attraction between the magnets, as shown in FIG. 5, the magnetic conductive part is provided with a barrier wall 72 to separate the two magnets. As shown in FIG. 2, the voice coil 2 has a racetrack shape, and the two magnets of the first magnet portion 6*a* face two straight sides of the racetrack-shaped voice coil 2. The two magnets of the second magnet portion 6*b* also face the two straight sides of the racetrack-shaped voice coil 2. This configuration may ensure that the magnetic field strength in the direction facing the voice coil is maximized, thereby further improving the sound production and vibration performance of the product.

Figure 6:
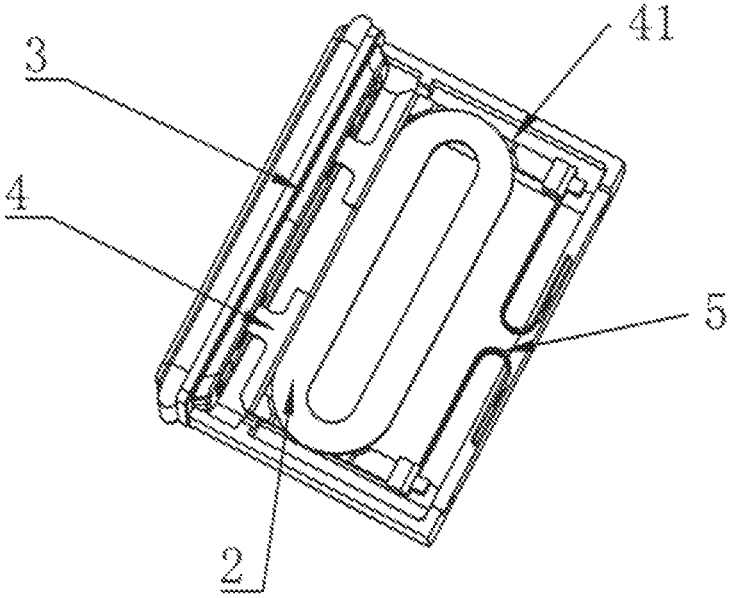
FIG. 6 is a schematic view of the assembly of the vibration system of the vibration sound-producing apparatus shown in FIG. 1.

As shown in FIGS. 2, 3 and 6, in the vibration sound-producing apparatus of the present embodiment, the voice coil 2 and the vibrating diaphragm 3 are connected with each other through connecting arms 4. As shown in FIG. 6, one end of the connecting arm 4 is fixed to the housing through the elastic piece 5, and the other end of the connecting arm 4 is combined with the vibrating diaphragm 3. The connecting arm 4 is provided with a recess 41 at a position facing the voice coil 2, and the shape of the recess 41 is adapted to the shape of the voice coil, so as to improve the bonding strength between the voice coil and the connecting arm, thereby ensuring timely transfer of vibration, and improving sound production performance. At the same time, in order to improve the rigidity of the portion of the vibrating diaphragm 3 combined with the transmission arms and adjust the acoustic performance of the product, as shown in FIGS. 2 and 3, the vibrating diaphragm 3 is provided with a reinforcing part 3*a* which is also provided on the central plane portion of the vibrating diaphragm 3. In order to balance the vibration of the vibrating diaphragm 3, it is preferred that the number of the connecting arms 4 is two, and the two connecting arms are fixedly connected to two ends of the voice coil 2 respectively.

In the vibration sound-producing apparatus of the present invention, the sound hole is provided in the side wall perpendicular to the thickness direction. The vibrating diaphragm is parallel to the plane in which the sound hole is located. The flat voice coil is perpendicular to the vibrating diaphragm. The magnet is parallel to the voice coil. The vibrating direction of the voice coil avoids the thickness direction. The vibrating direction of the integral structure of the magnet and the magnetic conductive part also avoids the thickness direction, which facilitates the thin-type design of the product, meanwhile, the space for vibration may be increased, and the product performance may be improved. In addition, the configuration of the two magnets and the magnetic conductive part effectively improves the magnetic field strength inside the product, and further improves product performance. In the vibration sound-producing apparatus of the present invention, the sound hole is provided in the lateral surface of the housing of the sound-producing apparatus, which avoids the requirement on the thickness of the external portable electronic terminal in the vertical direction due to a front sound hole, and avoids blocking of the sound hole and degradation of sound effect due to insufficient thickness in the vertical direction of the electronic terminal, thereby ensuring the sound effect of the vibration sound-producing apparatus. Therefore, the vibration sound-producing apparatus of the present invention has the advantages of improved thin-type design and great performance.

The above mentioned are only embodiments of the present invention and are not for limiting the present invention, thus the equivalent modification or variation made by those skilled in the art according to the present invention should be incorporated into the protection scope recorded in the claims.

The invention claimed is:

1. A vibration sound-producing apparatus, comprising: a housing, and a vibration system and a magnetic circuit system accommodated in the housing, wherein a lateral surface of the housing is provided with a sound hole for emitting sound;

the vibration system comprises a vibrating diaphragm, a voice coil and a transmission structure, the vibrating diaphragm is provided at a position corresponding to the sound hole, and a plane in which the vibrating diaphragm is located is parallel to the lateral surface in which the sound hole is located; the voice coil has a flat structure, and a plane in which the voice coil is located is perpendicular to the plane in which the vibrating diaphragm is located; and the vibrating diaphragm and the voice coil are connected with each other through the transmission structure;

the magnetic circuit system comprises a first magnet portion and a second magnet portion, and the first magnet portion and the second magnet portion are provided at two sides of the voice coil having the flat structure respectively; and the first magnet portion and the second magnet portion are arranged in parallel with the voice coil;

the vibration sound-producing apparatus further comprises a magnetic conductive part, a joint part and an elastic means; the magnetic conductive part is suspended inside the housing through the elastic means; the magnetic conductive part comprises a first magnetic conductive part and a second magnetic conductive part, the first magnet portion is fixed to the first magnetic conductive part, and the second magnet portion is fixed to the second magnetic conductive part; and the first magnetic conductive part and the second magnetic conductive part are connected with each other through the joint part.

2. The vibration sound-producing apparatus according to claim 1, wherein the first magnet portion and the second magnet portion are symmetrically arranged with respect to the voice coil, and a polarity of the first magnet portion at a side of the first magnet portion adjacent to the voice coil is opposite to a polarity of the second magnet portion at a side of the second magnet portion adjacent to the voice coil.

3. The vibration sound-producing apparatus according to claim 1, wherein the joint part consists of two parts, and the two parts of the joint part are provided at two ends of the magnetic conductive part correspondingly.

4. The vibration sound-producing apparatus according to claim 1, wherein the elastic means is an elastic piece, and the magnetic conductive part is vibratable in an elastic direction of the elastic piece.

5. The vibration sound-producing apparatus according to claim 1, wherein the magnetic conductive part is provided with a limiting block at a position where the joint part is fixed to the magnetic conductive part, and the joint part is provided with a limiting recess at a position corresponding to the limiting block.

6. The vibration sound-producing apparatus according to claim 1, wherein each of the first magnet portion and the second magnet portion comprises two magnets, and the two magnets of the first magnet portion and the two magnets of the second magnet portion are fixed to the first magnetic conductive part and the second magnetic conductive part, respectively.

7. The vibration sound-producing apparatus according to claim 6, wherein each of the first and second magnetic conductive parts is provided with a barrier wall, and the barrier wall separates the two magnets of the respective first and second magnet portions.

8. The vibration sound-producing apparatus according to claim 6, wherein the voice coil has a racetrack shape, the two magnets of the first magnet portion correspond to two straight sides of the voice coil having the racetrack shape, respectively, and the two magnets of the second magnet portion also correspond to the two straight sides of the voice coil having the racetrack shape, respectively.

9. The vibration sound-producing apparatus according to claim 1, wherein the transmission structure comprises a transmission arm, and the transmission arm is provided with a recess at a position where the voice coil is fixed to the transmission arm, wherein a shape of the recess is adapted to a shape of the voice coil.

10. The vibration sound-producing apparatus according to claim 9, wherein the transmission structure comprises two transmission arms, and the two transmission arms are provided at two ends of the voice coil.

11. The vibration sound-producing apparatus according to claim 3, wherein the magnetic conductive part is provided with a limiting block at a position where the joint part is fixed to the magnetic conductive part, and the joint part is provided with a limiting recess at a position corresponding to the limiting block.

12. The vibration sound-producing apparatus according to claim 7, wherein the voice coil has a racetrack shape, the two magnets of the first magnet portion correspond to two straight sides of the voice coil having the racetrack shape, respectively, and the two magnets of the second magnet portion also correspond to the two straight sides of the voice coil having the racetrack shape, respectively.

* * * * *